US007899379B2

(12) United States Patent
Izumi et al.

(10) Patent No.: US 7,899,379 B2
(45) Date of Patent: Mar. 1, 2011

(54) IMAGE FORMING APPARATUS AND TONER MANUFACTURING METHOD

(75) Inventors: Takao Izumi, Kanagawa-ken (JP); Takeshi Watanabe, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 447 days.

(21) Appl. No.: 12/013,561

(22) Filed: Jan. 14, 2008

(65) Prior Publication Data

US 2008/0170893 A1 Jul. 17, 2008

(30) Foreign Application Priority Data

Jan. 15, 2007 (JP) ..... 2007-005555

(51) Int. Cl.
*G03G 9/083* (2006.01)

(52) U.S. Cl. ..... 399/308; 399/275; 399/320

(58) Field of Classification Search ..... 399/275, 399/308, 320

See application file for complete search history.

(56) References Cited

U.S. PATENT DOCUMENTS 4,273,848 A * 6/1981 Inagaki et al. ..... 430/110.1
5,071,724 A * 12/1991 Goldman ..... 430/106.1
5,987,291 A * 11/1999 Masuda ..... 399/302
6,898,388 B2 * 5/2005 Uehara et al. ..... 399/69
6,970,666 B2 * 11/2005 Takahashi et al. ..... 399/101

FOREIGN PATENT DOCUMENTS

JP 06123998 A * 5/1994
JP 2002-298599 10/2002

* cited by examiner

*Primary Examiner*—Constantine Hannaher
(74) *Attorney, Agent, or Firm*—Turocy & Watson, LLP

(57) ABSTRACT

An image forming apparatus comprises toner with a coloring agent including magnetic powder as a nucleus arranged on a surface of one side of each toner particle, a toner image forming medium on which a toner image is formed using the toner, and a magnetic substance arranged at an opposite position to the toner image formed on the toner image forming medium.

6 Claims, 5 Drawing Sheets

IMAGE FORMING APPARATUS AND TONER MANUFACTURING METHOD

CROSS-REFERENCE TO RELATED APPLICATION

This application is based upon and claims the benefit of priority from the prior Japanese Patent Application No. 2007-005555 filed on Jan. 15, 2007, the entire contents of which are incorporated herein by reference.

BACKGROUND

1. Field of the Invention

The present invention relates to an image forming apparatus and a toner manufacturing method.

2. Description of the Related Art

In an image forming apparatus, among the cost of copying and printing, the rate occupied by toner is very high. Therefore, to reduce the cost, it is desirable to reduce the toner quantity adhered to a sheet to form an image. Therefore, conventionally, there is an image forming apparatus using toner having a toner save function for reducing the toner quantity to be consumed.

As a toner quantity reducing method when using the toner save function, for example, as described in Japanese Patent Application Publication No. 11-308450, there are a method for reducing the toner consumption quantity by reducing the number of printed dots by a method for thinning out the main scanning lines, that is, performing a thinning process every several dots in the overall image area and a method for reducing the toner quantity of each pixel available.

However, the toner save function by the conventional thinning process does not take the image quality into account. Among the toner components, the one contributing most to the image density is a pigment. When the toner consumption quantity is reduced, the pigment quantity per image unit area is reduced, so that the image density is lowered, thus a problem arises that a satisfactory image cannot be obtained.

SUMMARY

An object of the present invention is to provide an image forming apparatus and a toner manufacturing method for maintaining a satisfactory image even if reducing the toner quantity in the image formation.

According to the embodiments of the present invention, there are provided an image forming apparatus comprising toner with a coloring agent including magnetic powder as a nucleus arranged on a surface of one side of each toner particle; a toner image forming medium on which a toner image is formed using the toner; and a magnetic substance arranged at an opposite position to the toner image formed on the toner image forming medium.

Further, according to the embodiments of the present invention, there are provided a toner manufacturing method comprising forming a monomer composition for dispersing a mixture of additives such as a polymeric monomer, coloring agents including magnetic powder as a nucleus, a polymerization initiator, a cross-linker and a charging control agent; stirring the monomer composition in a water tank including a stabilization agent, thereby obtaining toner particles; and giving a magnetic field to the water tank and concentrating the coloring agents on one side of each of the toner particles.

DETAILED DESCRIPTION OF THE EMBODIMENTS

Hereinafter, the embodiments of the present invention will be explained with reference to the accompanying drawings.

Embodiment 1

Figure 1:
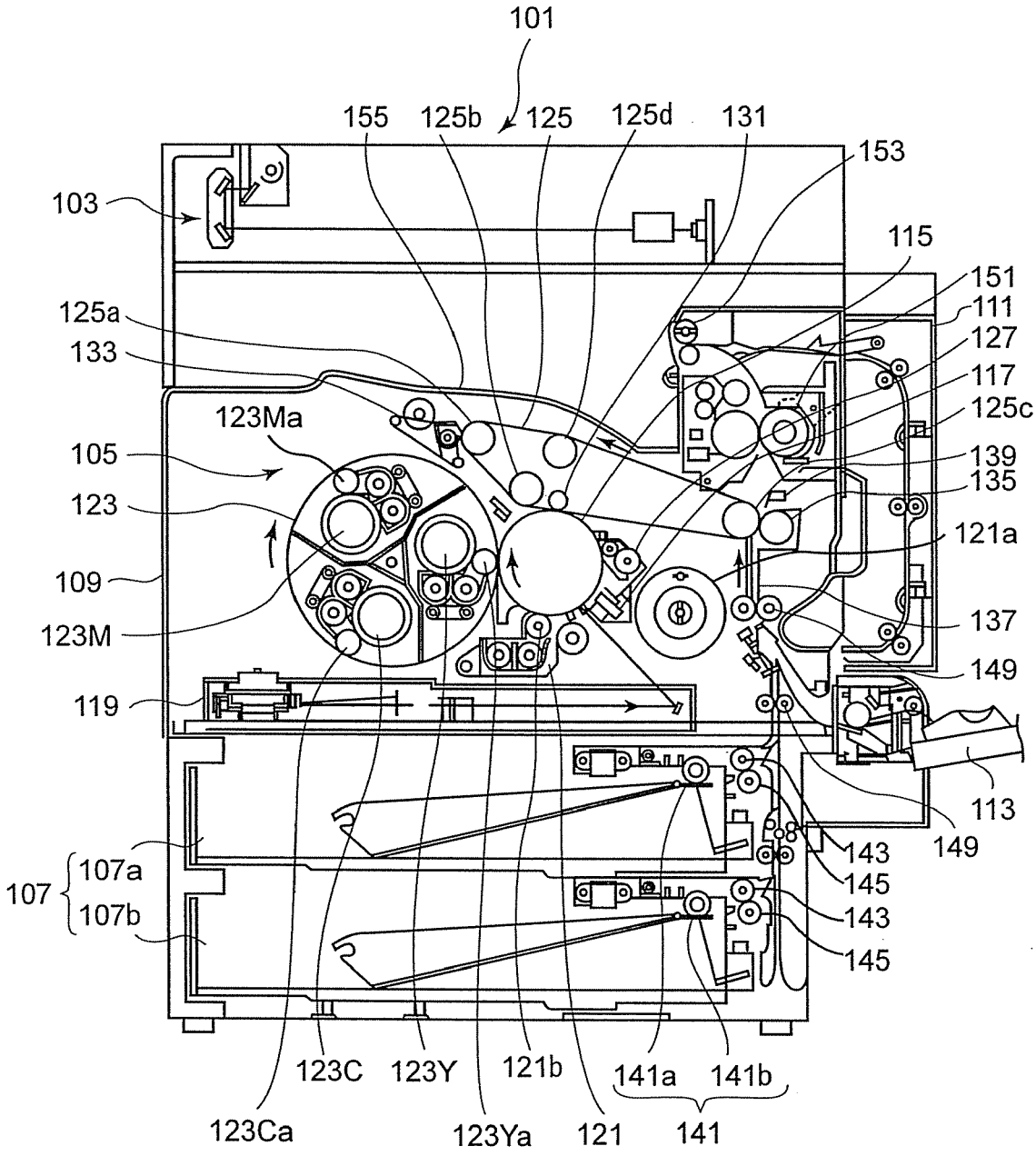
FIG. 1 is a schematic cross sectional view showing the main unit of the image forming apparatus which is an embodiment of the present invention.

FIG. 1 shows, as an image forming apparatus relating to the embodiments of the present invention, a schematic cross sectional view of the color image forming apparatus using the intermediate transfer system.

A color image forming apparatus 101 stores, in a frame 109, a document reading unit 103, an image forming unit 105, and a sheet feed unit 107. The document reading unit 103 irradiates light to a document not drawn which is set on the document table, leads the reflected light from the document to the light receiving element via a plurality of optical members, converts it photo-electrically, thereby outputs image data.

Further, the image forming unit 105 outputs an image based on image data read from a document by the document reading unit 103 or image data inputted from an external apparatus not drawn onto a recording medium P. Furthermore, the sheet feed unit 107 feeds the recording medium P to the image forming unit 105.

On the frame 109, an automatic duplex unit 111 and a manual paper supply unit 113 are attached removably. The automatic duplex unit 111 reverses the recording medium P on one side of which an image is formed by the image forming unit 105 and feeds it again to the image forming unit 105, thus an image is formed on the residual one side. The manual paper supply unit 113 supplies manually the recording medium P to the image forming unit 105.

Next, the image forming unit 105 will be explained in detail. The image forming unit 105 has a photosensitive drum 115 which is a toner image forming medium having a pipe shaft extending in the longitudinal direction (the depth direction of the drawing) of the color image forming apparatus 101. Around the photosensitive drum 115, a main charger 117, an exposure unit 119, a black developing device 121, a revolver 123 which is a color developing device, an intermediate transfer belt 125 which is a transfer medium, and a drum cleaner 127 are installed in the rotational direction (the direction of the arrow in the drawing) of the photosensitive drum 115.

The main charger 117 charges the outer peripheral surface of the photosensitive drum 115 at a predetermined potential. The exposure unit 119 is arranged in the neighborhood of the lower end of the image forming unit 105, exposes the surface of the photosensitive drum 115 which is charged at the predetermined potential, thereby forms an electrostatic latent image based on the image data. When forming a color image, the exposure unit 119 exposes the surface of the photosensitive drum 115 on the basis of the color-resolved image data and forms an electrostatic latent image of each color.

The black developing device 121 is arranged between the photosensitive drum 115 and the exposure unit 119, that is, opposite to the photosensitive drum 115 from underneath. The black developing device 121 adheres and develops black toner to the electrostatic latent image for black formed on the surface of the photosensitive drum 115 by the exposure unit 119 and forms a black toner image on the surface of the photosensitive drum 115.

The black developing device 121 has a mixer for stirring and feeding toner and a black developing roller 121*b* which is a magnetic roller arranged opposite to it on the surface of the photosensitive drum 115 via a predetermined development gap. The black developing device 121 is installed movably so as to permit the black developing roller 121*b* to make contact with and separate from the surface of the photosensitive drum 115. Further, to the black developing device 121, toner is fed from a toner cartridge 121*a* via a feed path not drawn.

The revolver 123 is installed in the neighborhood of the photosensitive drum 115 so as to rotate clockwise. The revolver 123 has a yellow developing device 123Y, a magenta developing device 123M and a cyan developing device 123C which have the same structure as that of the black developing device 121. The developing devices are arranged side by side in the rotational direction of the revolver 123 and are stored removably in the revolver 123. The color developing devices 123Y, 123M and 123C have a yellow developing roller 123Ya, a magenta developing roller 123Ma and a cyan developing roller 123Ca which are arranged opposite to them on the surface of the photosensitive drum 115 via a predetermined gap.

The color developing devices 123Y, 123M and 123C, when the revolver 123 rotates clockwise, are arranged selectively opposite to the surface of the photosensitive drum 115 from the side thereof.

The black developing device 121, since the frequency in use is higher than those of the developing devices of the other colors, is installed separately from the revolver 123 storing the developing devices of the other colors. Therefore, the toner storage capacities of the developing devices and toner cartridges can be made different from those of the developing devices of the other colors, thus the number of times of maintenance such as toner feed can be reduced.

The intermediate transfer belt 125 is arranged above the photosensitive drum 115. The intermediate transfer belt 125 is wound round a drive roller 125*a* having the rotary shaft extending in the longitudinal direction (the depth direction of the drawing) of the color image forming apparatus 101, a driven roller 125*b*, a driven roller 125*c*, and a tension roller 125*d* and is stretched by them. The drive roller 125*a* is installed fixedly to the frame 109 above the revolver 123. The tension roller 125*d*, so as to give predetermined tension to the intermediate transfer belt 125, is pressed from the inside of the intermediate transfer belt 125 toward the outside thereof.

Inside the intermediate transfer belt 125, to permit the intermediate transfer belt 125 to make contact with the surface of the photosensitive drum 115 and transfer a toner image formed on the surface of the photosensitive drum 115 to the intermediate transfer belt 125, a first transfer roller 131 is installed. The first transfer roller 131 is pressed toward the photosensitive drum 115 so as to press the intermediate transfer belt 125 to the surface of the photosensitive drum 115 at a predetermined pressure.

Around the intermediate transfer belt 125, a belt cleaner 133 and a secondary transfer roller 135 are installed touchably on the belt surface. The belt cleaner 133 is installed on the outer periphery of the drive roller 125*a* via the intermediate transfer belt 125 above the revolver 123.

The secondary transfer roller 135 of this embodiment has an outside diameter of 28 mm and is composed of an epichloro rubber sponge the surface of which is coated with an epichloro rubber tube. The rubber hardness is 25 to 30 degrees and the volume resistance is $10^7\Omega$.

Further, the secondary transfer roller 135 is installed via the intermediate transfer roller 125 at the position between the driven roller 125*c* and it across a vertical conveying path 137 which will be described later and forms the secondary transfer area at this part. The drum cleaner 127 is arranged in contact with the photosensitive drum 115.

The sheet feed unit 107 has two sheet feed cassettes 107*a* and 107*b*. At the right upper ends of the sheet feed cassettes 107*a* and 107*b* shown in the drawing, pickup rollers 141 (141*a*, 141*b*) for taking out the recording media P at the uppermost ends stored in the cassettes are installed. At the positions in the neighborhood of the downstream side in the recording medium takeout direction by the pickup rollers 141, feed rollers 143 and separation rollers 145 are arranged respectively opposite to each other.

Further, at the neighboring position of the sheet feed cassettes 107*a* and 107*b* on the right of the drawing, the vertical conveying path 137 extending almost in the perpendicular direction through the secondary transfer area where the intermediate transfer belt 125 and secondary transfer roller 135 make contact with each other is installed. On the vertical conveying path 137, a plurality of paired conveying rollers 149 for rotating by holding the recording media P are installed.

Above the discharge unit of the recording media P in the secondary transfer area, a fixing device 151 for heating, pressurizing, and fixing a toner image transferred onto each of the recording media P is installed.

Further, exit rollers 153 for discharging the image-formed recording media P to a sheet receiving tray 155 is installed.

Next, the color image forming operation by the color image forming apparatus will be explained. As an initial operation, the black developing device 121 moves down and separates from the surface of the photosensitive drum 115, and the revolver 123 rotates clockwise, and the yellow developing device 123Y faces the surface of the photosensitive drum 115. Further, the belt cleaner 133 rotates counterclockwise around the support shaft thereof and separates from the intermediate transfer belt 125, and the secondary transfer roller 135 moves in the direction (in the right direction of the drawing) separating from the vertical conveying path 137 and separates from the intermediate transfer belt 125.

And, image data is read from a document not drawn by the document reading unit 103 or image data is inputted from an external apparatus not drawn. Furthermore, the photosensitive drum 115 rotates clockwise and the surface of the photosensitive drum 115 is charged uniformly at a predetermined potential by the main charger 117. At this time, the intermediate transfer belt 125 rotates counterclockwise at the same speed as the peripheral speed of the photosensitive drum 115.

Firstly, on the basis of the color-resolved yellow image data, the exposure unit 119 operates and forms an electrostatic latent image for yellow on the surface of the photosensitive drum 115. At this time, the exposure timing is synchronized by detecting a detection mark, not drawn, stuck inside the intermediate transfer belt 125 by a detector not drawn.

The electrostatic latent image for yellow formed on the surface of the photosensitive drum 115 by the yellow developing device 123Y is adhered with yellow toner and is developed, thus a yellow toner image is formed on the surface of the photosensitive drum 115. The yellow toner image formed on the surface of the photosensitive drum 115 in this way is moved by rotation of the photosensitive drum 115 and passes through the primary transfer area in contact with the intermediate transfer belt 125.

At this time, a bias voltage with reverse polarity to the charging polarity of each toner particle is given to the primary transfer roller 131 and the yellow toner image on the surface of the photosensitive drum 115 is transferred onto the intermediate transfer belt 125.

After the yellow toner image is transferred onto the intermediate transfer belt 125, the yellow toner remaining on the surface of the photosensitive drum 115 without being transferred is removed by the drum cleaner 127. At this time, the residual electric charge on the surface of the photosensitive drum 115 is also neutralized simultaneously.

And, to set up for forming the next electrostatic latent image for magenta on the photosensitive drum 115, the surface of the photosensitive drum 115 is charged uniformly by the main charger 117, and the revolver 123 is rotated, and the magenta developing device 123M faces the surface of the photosensitive drum 115.

In this state, a series of processes aforementioned, that is, exposure, development, and primary transfer onto the intermediate transfer belt 125 are executed, and a magenta image is superimposed and transferred onto the yellow toner image on the intermediate transfer belt 125.

After a cyan toner image is transferred similarly, to the position where the developing devices 123Y, 123M and 123C do not face the surface of the photosensitive drum 115, the revolver 123 rotates and the black developing device 121 moves up in place and faces the surface of the photosensitive drum 115. In this state, the processes similar to the aforementioned processes are executed, and a black toner image is superimposed on the yellow toner image, magenta toner image, and cyan toner image and is transferred onto the intermediate transfer belt 125.

When the toner images of all the colors are superimposed on the intermediate transfer belt 125 in this way, the secondary transfer roller 135 moves toward the driven roller 125*c* and makes contact with the intermediate transfer belt 125. Further, the belt cleaner 133 also makes contact with the intermediate transfer belt 125. The toner images of all the colors superimposed on the intermediate transfer belt 125 in this state rotate due to rotation of the intermediate transfer belt 125 and passes through the secondary transfer area where the intermediate transfer belt 125 and the secondary transfer roller 135 are in contact with each other.

At this time, the recording medium P taken out from the sheet feed cassette 107*a* or 107*b* by the pickup roller 141*a* or 141*b* is conveyed upward on the vertical conveying path 137 by the conveying roller 149 and is sent into the secondary transfer area at predetermined timing.

And, via the secondary transfer roller 135 impressed with a bias voltage having reverse polarity to that of the toner image of each color by the power source which will be described later, the toner images of all the colors on the intermediate transfer belt 125 are transferred in a batch onto the recording medium P. After the toner images are transferred to the recording medium P, the toner remaining on the intermediate transfer belt 125 is removed by the belt cleaner 133. The recording medium P on which the toner images of all the colors are transferred together is heated and pressurized by the fixing device 151, and the toner images of all the colors are fixed on the recording medium P, thus a color image is formed. The recording medium P on which the color image is formed is discharged onto the sheet receiving tray 155 via the exit rollers 153 installed on the downstream side of the fixing device 151.

Figure 2:
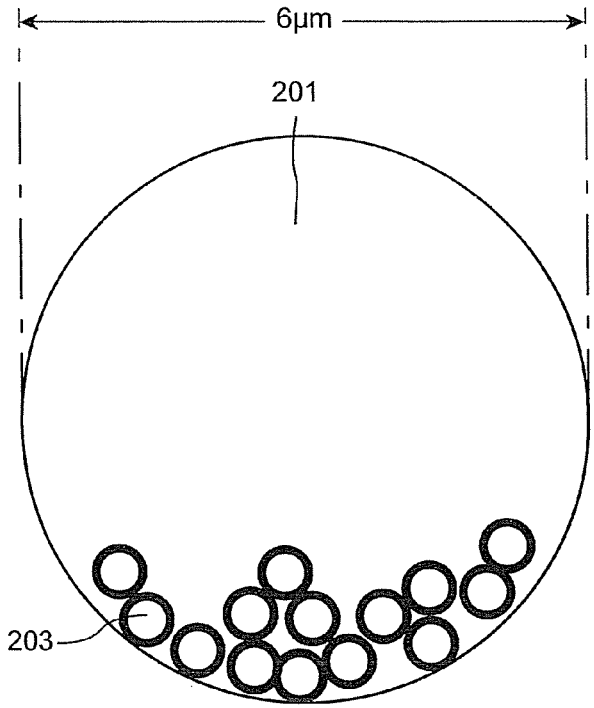
FIG. 2 is a schematic view showing a toner particle with the coloring agents used in Embodiment 1 of the present invention arranged on one side thereof.
Figure 3:
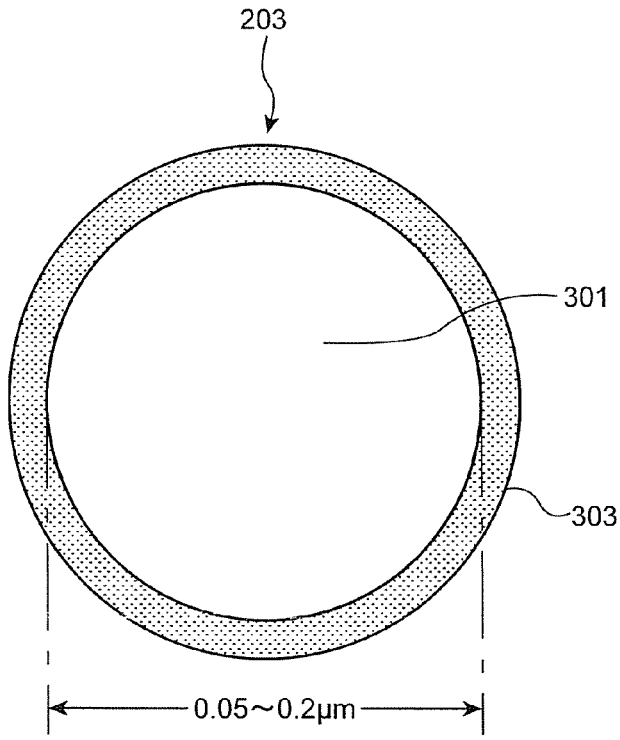
FIG. 3 is a schematic view showing the coloring agent.

The toner used in this embodiment will be explained below. As shown in FIG. 2, a toner particle 201 used in this embodiment has a particle diameter which is a volume average particle diameter of 6 μm and includes coloring agents 203 arranged on the surface of the complementary hemisphere. Here, as the coloring agents 203, for example, in the case of black toner, magnetic powder 301 itself can be used or magnetic power with carbon black adhered on the surface of the magnetic powder 301 can be used. In the case of color toner, as the coloring agents 203, as shown in FIG. 3, magnetic powder 301 with a pigment 303 of each color adhered on the surface of the magnetic powder 301 is used.

As the magnetic powder 301, for example, magnetic powder having magnetic coercive force of 10 to 1,800 Oe (0.8 to 143.2 kA/m), saturation magnetization of 50 to 130 emu/g (50 to 130 $Am^2$), and residual magnetization of 1 to 65 emu/g (1 to 65 $Am^2$) is used. Further, the volume average particle diameter is suitably 0.05 to 0.2 μm or so. Further, as shown in FIG. 3, the coloring agents 203 have a particle diameter of the order of submicron which is similar to or slightly larger than that of the magnetic powder 301.

As the pigment 303, a pigment for coloring yellow, magenta, and cyan is used. As a pigment for yellow, a monoazo pigment, a disazo pigment, a condensation azo-pigment, and an isoindolin pigment can be used. As a magenta pigment, a quinacridone pigment, an azo-pigment, a condensation azo-pigment, and a perylene pigment can be used. As a cyan pigment, a phthalocyanine pigment can be used.

Next, a method for manufacturing toner composed of the magnetic powder 301 of this embodiment arranged on the surface of a complementary hemisphere will be explained. As a manufacturing method, the suspension polymerization method is suitable. In the suspension polymerization method, toner is obtained by stirring a monomer composition for dispersing a mixture of additives such a polymeric monomer, the coloring agents 203 composed of magnetic powder 301 as a nucleus, moreover, a polymerization initiator, a cross-linker, and a charging control agent in a water tank including a stabilization agent, thereby producing particles, and polymerizing them to a desired particle size.

The coloring agents 203 composed of the magnetic powder 301 as a nucleus has high specific gravity, so that the gravity direction in the particles is concentrated on one side (FIG. 2). When the offset is insufficient, by formation of a magnetic field during production of particles, the offset of the coloring agents 203 in the direction of magnetic force can be assisted.

Next, the image forming process when using the toner particles 201 aforementioned will be explained. To uniform the toner directions at the developing step, the developing rollers 121*b*, 123Ya, 123Ma and 123Ca are acceptably magnet rollers.

When the developing rollers 121*b*, 123Ya, 123Ma and 123Ca are formed by magnet rollers, a magnetic field is formed between the photosensitive drum 115 and the developing rollers 121*b*, 123Ya, 123Ma and 123Ca, thus at time of development, the sides of the toner particles 201 where the coloring agents 203 are arranged are uniformed in the state that they face the developing rollers 121*b*, 123Ya, 123Ma and 123Ca.

Figure 4:
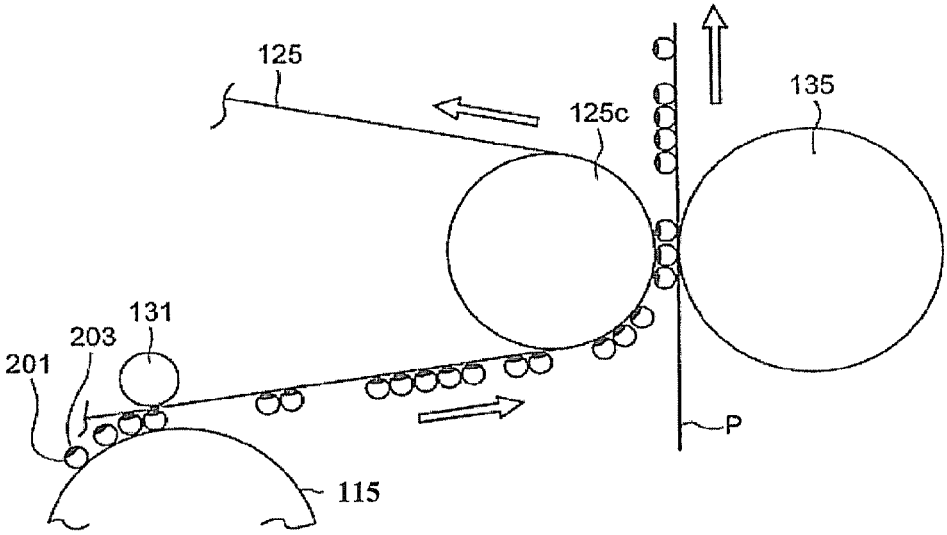
FIG. 4 is a schematic view for explaining the process of aligning the directions of toner particles at the development step.

Therefore, as shown in FIG. 4, in the toner particles 201 on the photosensitive drum 115, the coloring agents 203 are adhered in the state that they are all directed toward the surface. And, the toner particles 201 adhered to the photosensitive drum 115 are transferred to the intermediate transfer belt 125. The toner particles 201 transferred to the intermediate transfer belt 125, as shown in FIG. 4, are in the state that the coloring agents 203 are directed toward the intermediate transfer belt 125.

In this state, the toner particles 201 are moved by rotation of the intermediate transfer belt 125 and when they reach the secondary transfer area, the toner particles 201 are transferred to the recording medium P. The toner particles 201 transferred to the recording medium P are in the state that the coloring agents 203 are arranged side by side on the surface of the recording medium P.

As mentioned above, when forming an image so that the coloring agents are arranged on the surface of the complementary hemisphere of each toner particle and the coloring agents are arranged side by side on the surface of the recording medium P, even if the adhesion quantity of toner is little, an image at high image density is obtained.

Further, in the explanation aforementioned, the directions of the toner particles are uniformed at the developing step, though when a proper magnetic field is applied within the range that the toner particles do not move, it is possible to rotate the toner particles and uniform the directions thereof.

Figure 5:
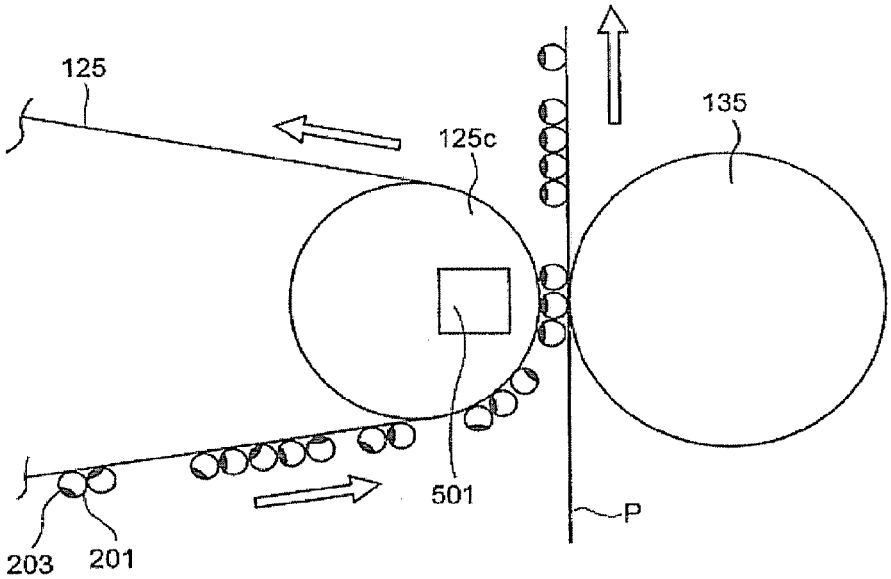
FIG. 5 is a schematic view for explaining the process of aligning the directions of toner particles at the transfer step.

For example, at the transfer step, a means for aligning the directions of toner particles will be explained. As shown in FIG. 5, a magnetic member 501 is arranged inside the driven roller 125*c*. By doing this, even if toner particles are transferred onto the intermediate transfer belt 125 in the state that the directions of the coloring agents 203 are not uniform, by the magnetic member 501 inside the driven roller 125*c*, when they are transferred from the intermediate transfer belt 125 to the recording medium P, the sides of the toner particles 210 where the coloring agents 203 are arranged by the magnetic field are arranged side by side on the surface of the recording medium P.

Embodiment 2

Figure 8:
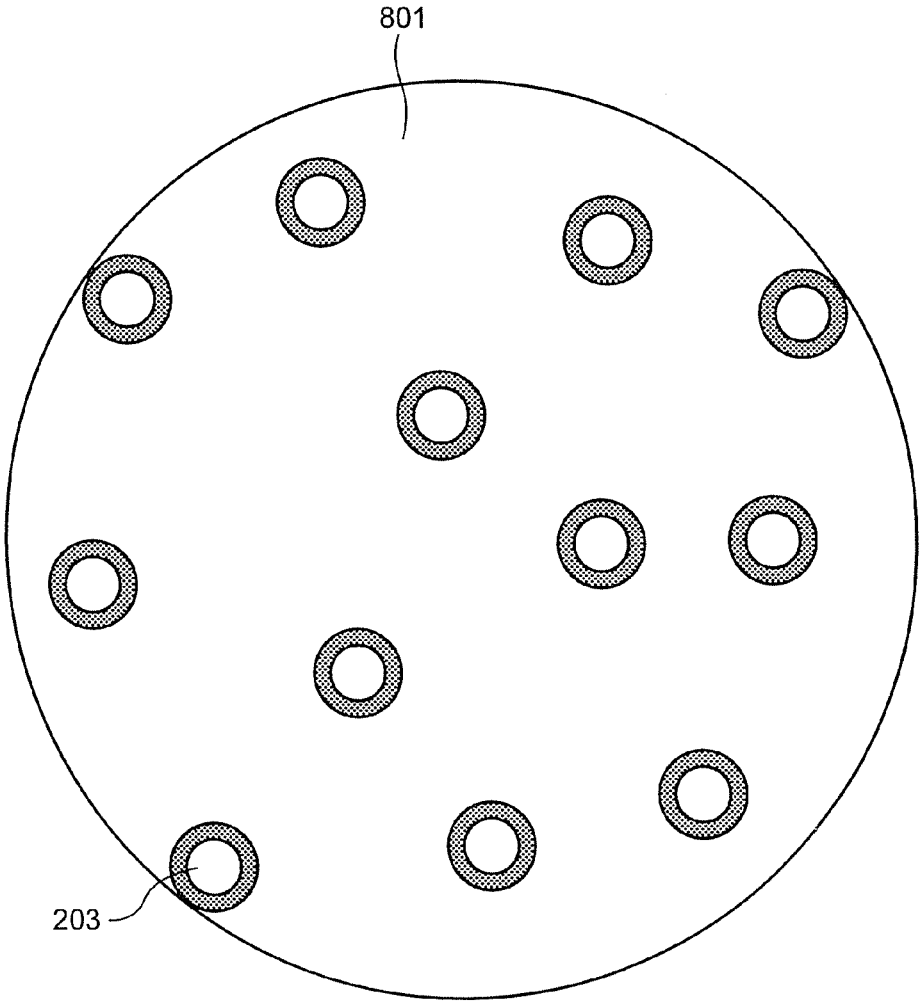
FIG. 8 is a schematic view of a toner particle with the coloring agents used in Embodiment 2 of the present invention arranged overall.

In the embodiment aforementioned, the toner particles 201 composed of the coloring agents 203 arranged on the surface of the complementary hemisphere are used, while in this embodiment, as shown in FIG. 8, the case that toner particles 801 composed of the coloring agents 203 arranged free of offset on the surface of each toner particle will be explained. In the toner particles 801 used in this embodiment, the coloring agents 203 arranged on the surface are smaller in the amount than the conventional toner particles.

Figure 6:
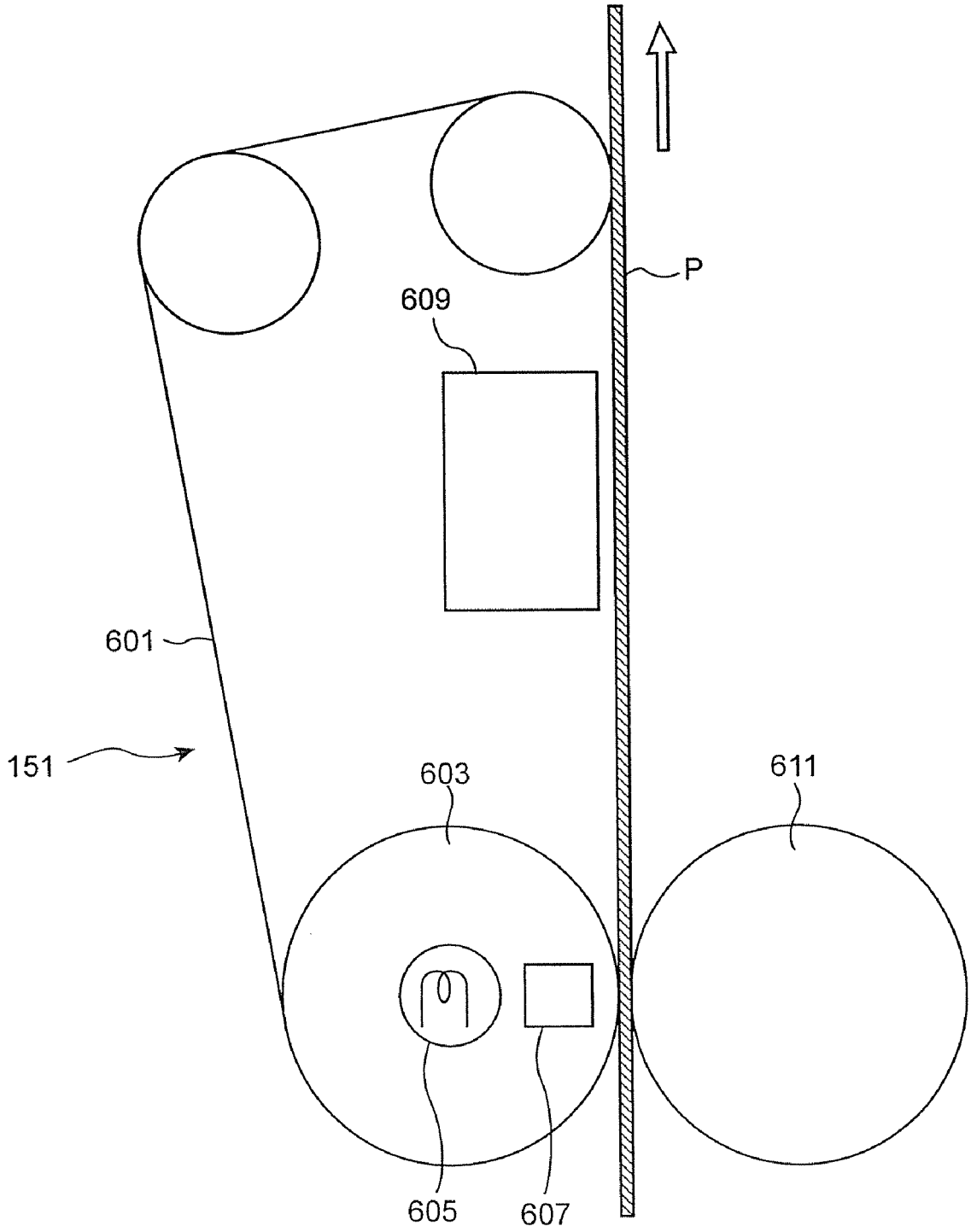
FIG. 6 is a schematic view of the fixing device used in Embodiment 2 of the present invention.

FIG. 6 is a drawing showing the schematic constitution of a fixing device 151' of Embodiment 2. In the fixing device 151' of this embodiment, a fixing belt 601, a fixing roller 603, a tungsten halogen lamp 605, a magnetic member 607, a cooling mechanism 609, and a backup roller 611 are installed. The tungsten halogen lamp 605 and magnetic member 607 are installed inside the fixing roller 03 and when the tungsten halogen lamp 605 is turned on, heat is given to the toner particles 801 on the recording medium P via the fixing belt 601. Further, by the magnetic member 607, a magnetic field is generated in the fixing nip section.

The fixing step of this fixing device 151' will be explained below. When the recording medium P on the surface of which the toner particles 801 are transferred is conveyed to the fixing nip section of the fixing device 151', the integrating resin composing the toner particles 801 is melted by heat temporarily to a liquid.

Figure 7:
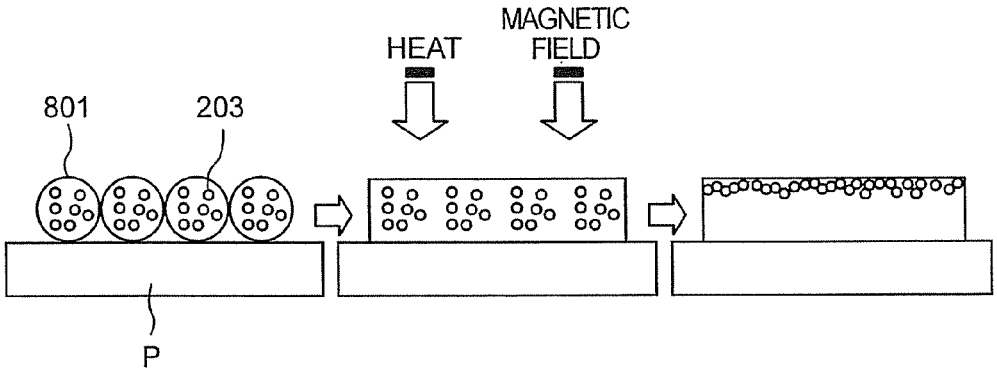
FIG. 7 is a drawing for explaining the fixing step of Embodiment 2 of the present invention.

As shown in FIG. 7, in the resin melted to a liquid, there are the coloring agents 203 including the magnetic powder 301 as a nucleus and the coloring agents 203 are attracted toward the fixing roller 603 in the resin melted to a liquid by the magnetic member 607 installed inside the fixing roller 603. The recording medium P coming out from the fixing nip is conveyed in contact with the fixing belt 601 and the toner particles 801 are cooled and hardened by the cooling mechanism 609.

When forming an image using the toner particles 801 in which the coloring agents 203 in a slightly small amount than general toner are arranged allover the surfaces of the toner particles 801 and the fixing device aforementioned, the coloring agents 203 for deciding the image density can be concentrated on the surface of the recording medium P, thus an image at a high image density can be obtained using very few toner particles 801.

What is claimed is:

1. An image forming apparatus comprising:

toner with coloring agents including magnetic powder as a nucleus arranged on a surface of the complementary hemisphere of each toner particle;

a toner image forming medium on which a toner image is formed using the toner; and a magnetic substance arranged at an opposite position to the toner image formed on the toner image forming medium.

2. The apparatus according to claim 1, wherein the toner image forming medium includes a photosensitive drum.

3. The apparatus according to claim 2, wherein the magnetic substance includes a magnetic roller to form the toner image on the photosensitive drum.

4. The apparatus according to claim 2, wherein the toner image forming medium includes an intermediate transfer belt to which the toner image formed on the photosensitive drum is transferred.

5. The apparatus according to claim 4 further comprising:

a driven roller over which the intermediate transfer belt is stretched; and a secondary transfer roller arranged in contact with the driven roller via the transfer belt, wherein the magnetic substance is provided inside the driven roller.

6. An image forming apparatus comprising:

toner with coloring agents including magnetic powder as a nucleus arranged on a surface of the complementary hemisphere of each toner particle;

an image carrier on which a toner image is formed using the toner;

an intermediate transfer belt to carry the toner image transferred from the image carrier;

a driven roller over which the intermediate transfer belt is stretched;

a secondary transfer roller arranged in contact with the driven roller via the transfer belt; and a magnetic substance provided inside the driven roller.

* * * * *